United States Patent [19]

Linner

[11] 4,070,952

[45] Jan. 31, 1978

[54] CARTON STORAGE, FEEDING AND OPENING APPARATUS

[75] Inventor: Hans Rolf Ingemar Linner, Helsingborg, Sweden

[73] Assignee: AB Akerlund & Rausing, Lund, Sweden

[21] Appl. No.: 777,720

[22] Filed: Mar. 15, 1977

[30] Foreign Application Priority Data

Nov. 12, 1976 Sweden ..... 7612635

[51] Int. Cl.[2] ..... B31B 1/06; B31B 1/78

[52] U.S. Cl. ..... 93/53 R; 93/53 AC; 271/150; 271/155

[58] Field of Search ..... 93/53 R, 53 SD, 53 BF, 93/53 AC; 53/186; 271/149, 150, 30 A, 129, 155, 171

[56] References Cited

U.S. PATENT DOCUMENTS

| | | | |
|---|---|---|---|
| 1,638,399 | 8/1927 | Howard | 93/53 R |
| 1,779,817 | 10/1930 | Lane | 53/186 |
| 1,848,707 | 3/1932 | Gangler | 93/53 R |
| 2,643,497 | 6/1953 | Woelfer | 93/53 R X |
| 3,044,371 | 7/1962 | Gastright | 93/53 AC |
| 3,216,175 | 11/1965 | Stohlquist | 93/53 R X |
| 3,258,893 | 7/1966 | Jones | 53/186 |
| 3,521,427 | 7/1970 | Masch | 53/186 |

*Primary Examiner*—James F. Coan

*Attorney, Agent, or Firm*—Lerner, David, Littenberg & Samuel

[57] ABSTRACT

A packaging machine is disclosed in which the carton storage, feeding and opening station is adjustable for different size cartons. The storage area has an adjustable bottom and walls and the opening mechanism has an adjustable path of travel, dependent upon the carton size.

4 Claims, 5 Drawing Figures

CARTON STORAGE, FEEDING AND OPENING APPARATUS

BACKGROUND OF THE INVENTION

The present invention relates to packaging machines in which a series of folding boxes fed one after another in a predetermined direction with a substantially constant center to center distance are processed in various stations and, more particularly, to a box storage, feeding and opening station for such a machine which is adjustable for processing different size boxes.

Principally, such a machine comprises an endless conveyor, such as a chain or a band running in the horizontal plane and provided with equally spaced carriers for folding boxes of cardboard or similar material. From a plane condition in a storage area the folding boxes are fed to the conveyor and simultaneously erected into a substantially case-shaped configuration with top and bottom endwall flaps extending from the body portion of the folding box. In a conventional machine of this type the erected folding boxes are conveyed to the following stations: a transverse-wall and longwall flap unfolding station, a sealing strip application and sealing station, a sealing strip cross-cutting station and a flap-folding and sealing station. These stations are located along a rectilinearly extending portion of the conveyor and operate upon the bottom ends of the folding boxes. After the bottom sealing has been accomplished, at the end of the rectilinear portion the folding boxes are filled in a filling station, preferably situated along a curved portion of the conveyor, after which the folding boxes are conveyed along a second rectilinear portion in a direction opposite to that of the first rectilinear portion. With the exception of the transverse-wall and longwall flap unfolding station, the second rectilinear portion is provided with stations identical with those of said first portion, however with the difference that the latter operate upon the top ends of the folding boxes. At the end of the second rectilinear portion there is a discharge station for the filled and sealed folding boxes.

Basically, this machine is reliable and practical. However, it would be desirable to provide apparatus for the storage, feeding and opening of folding box blanks which is adjustable for boxes within a maximally large size range. With the known machine in such a case difficulties are encountered in the adaptation of existing storage, feeding and opening apparatus to various folding box sizes. It is important that the folding box blanks can be fixed in a position in the storage area in which the feeding takes place exactly defined in relation to the conveyor and the folding box carriers mounted thereon and also in relation to the gripper means which removes the blanks from the storage area.

It is therefore a primary object of this invention to provide size adjustable storage, feeding and opening apparatus for folding box blanks.

SUMMARY OF THE INVENTION

This invention accordingly provides a storage area having a vertically adjustable, substantially horizontal, lengthened storage bottom and a pair of adjustable side guiding means for folding box blanks substantially vertically carried by the storage bottom. The side guiding means are each independently adjustable. Further, the opening mechanism has an adjustable path of travel, dependent upon the box size.

DESCRIPTION OF THE DRAWING

In order to clearly explain the inventive concept a preferred embodiment thereof now will be described with reference to the drawings in which.

DESCRIPTION OF THE PREFERRED EMBODIMENT

Figure 1:
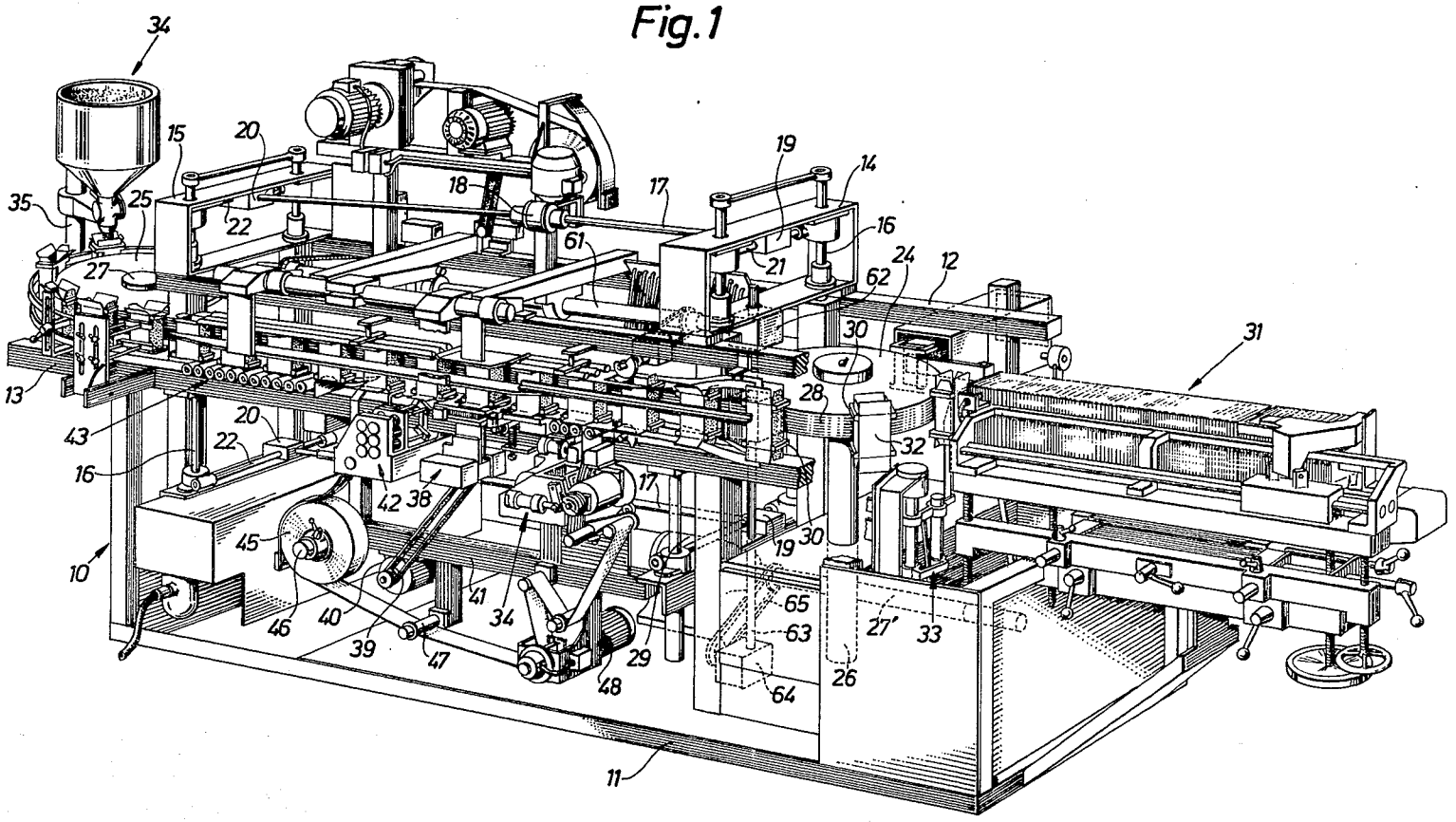
FIG. 1 is a perspective view of a packaging machine including the arrangement according to the invention.

The packaging machine shown in FIG. 1 is provided with a main stand 10 which by means of a bottom frame 11 rests upon a substantially horizontal floor. The main stand 10 carries an upper deck 12 and a lower deck 13, respectively, which are simultaneously vertically displaceable in opposite directions. Each of said decks consists of a frame structure. In the area of the transverse ends the upper deck 12 is provided with boxlike housings 14 and 15. Each of the housings serve as a guide means for the top ends of a pair of jack screws 16. The housings 14 and 15 are interconnected by means of a shaft 17, which is driven by a worm gear motor 18, and by means of worm gears 19, 20 in the two housings 14, 15 transverse shafts 21, 22 are driven which in turn rotate the screws 16 when the motor 18 is running. The lower deck 13 is provided with a corresponding set of shafts and worm gears and a worm gear motor. Owing to the fact that the screws 16 have oppositely threaded portions in the areas of the deck 12 and the deck 13, respectively, the deck 12 and the deck 13 will be moved vertically in opposite directions responsive to the rotation of the screws 16. If the threads of screws 16 have the same pitch, the movement in opposite directions of course will have equal displacements.

The stand 10 by means of shafts 26, 27 carries a pair of wheels 24, 25 about which an endless steel band 28 is running and extends in the horizontal plane. The shaft 26 by means of a drive shaft 27' is driven from a main motor 29. The wheel 24 therefore is the driving wheel of the two wheels 24, 25, and by controlling the motor 29, such as by frequency control, the wheel 24 and accordingly the band 28 may be given a desired driving speed, at which the movement in the shown embodiment will be an intermittent movement with a variable speed. On the band 28 are mounted equidistant carriers 30. In the shown embodiment carriers for folding boxes of moderate size are shown, but these carriers may be replaced by carriers of a smaller or larger size, and thus the distance between the carriers, as measured between adjacent carrier arms, will vary dependent upon the selected folding box size. It is for instance possible to use folding boxes having a length in the conveying direction as small as 65 mm and as large as 142 mm. The carriers 30 are tightened on the band 28 and are easily replaceable.

At the right end of the machine shown in FIG. 1 the stand 10 carries a storage area 31 for folding boxes in plane condition. As will be described in more detail by the following, the storage area 31 is provided with a gripper means 33 which removes individual plane folding boxes from the storage area and inserts them one by one into the carriers 30 while the folding boxes simultaneously are erected as shown in FIG. 1. At the curved left end of the conveyor in FIG. 1 is mounted a filling means 34 which may be carried either directly by the stand 10 or, as indicated, by a separate stand 35.

Apart from a pair of endflap unfolders 36, along the two straight conveyor portions identical processing stations are provided for the bottom ends and top ends of the folding boxes, and in this connection therefore merely the processing stations for the bottom ends will be described, i.e. the stations and means carried by the lower deck 13.

With reference to the endflap unfolders 36 these are of known construction, such as of the type described in Swedish Pat. Nos. 342,180; 342,181 or 343,519. The purpose of the flap unfolders is to unfold the upper and lower transverse flaps into a horizontal position, in order to make it possible to apply a sealing strip against the bottom end and the top end, respectively, of the folding box. The longwall flaps are also unfolded into horizontal position by longwall flap guide means preceding the unfolders 36.

As seen in the conveying direction, after the flap unfolders 36 follows the sealing strip application station 37 according to copending U.S. patent application Serial No. filed concurrently herewith.

After the sealing strip application station, still as seen in the conveying direction of the folding boxes, follows a sealing strip sealing station 38 which in the shown embodiment is provided with a vibration heating jaw, such as of the type described in U.S. Pat. No. 3,787,257. The vibration heating jaw in the sealing station 38, by means of a chain 39, is driven from a drive motor 40 controlled in response to the speed of the main motor 29. This means that the vibration frequency of the heating jaw will be directly dependent on the speed of the motor 29 and consequently also on that of the conveyor band 28. Like the various units in the sealing label application station 37, this motor 40 is carried by a subframe 41 secured to the lower deck 13.

After the sealing strip sealing station 38 follows a transverse-flap folding station 42 according to copending U.S. patent application Ser. No. 777,721, filed concurrently herewith. Then follows a known longwall flap folder in the shape of lengthened rails (not shown) serving as guide means for said flaps and folding them inwards over the transverse flaps previously folded inwards in the station 42. Said longwall flap folder alternatively may be of a type similar to that of the transverse flap folder.

At the end of the straight portion of the conveyor is situated a flap sealing station 43 which consists of a number of conventional heating elements.

After the individual folding boxes have been conveyed along the straight portion of the conveyor just described, they are ready to be filled from their top side in the filling station 34.

In accordance with the principles of this invention, the storage area generally indicated by reference numeral 31 in FIG. 1 is provided.

Figure 2:
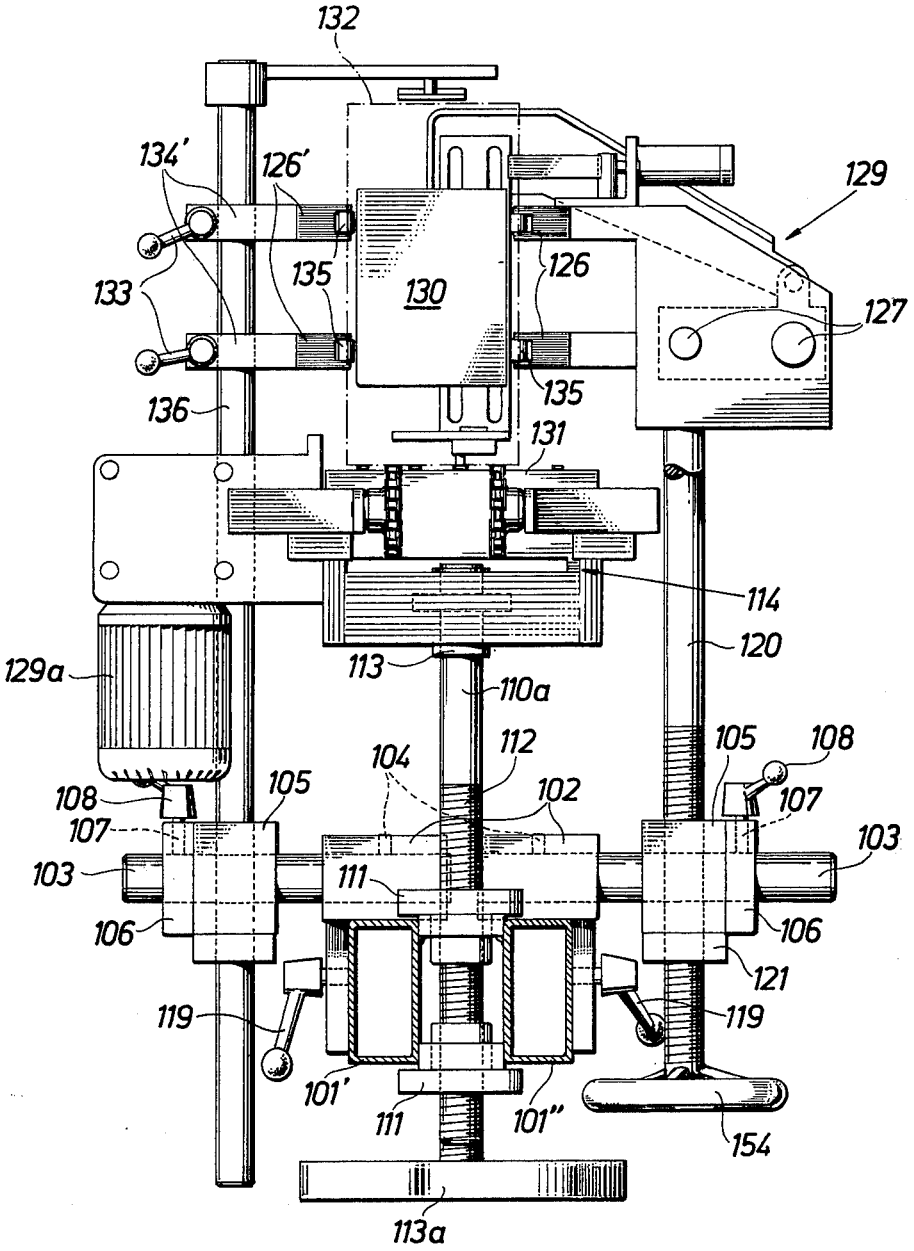
FIG. 2 shows the feeding end of the storage area.
Figure 3:
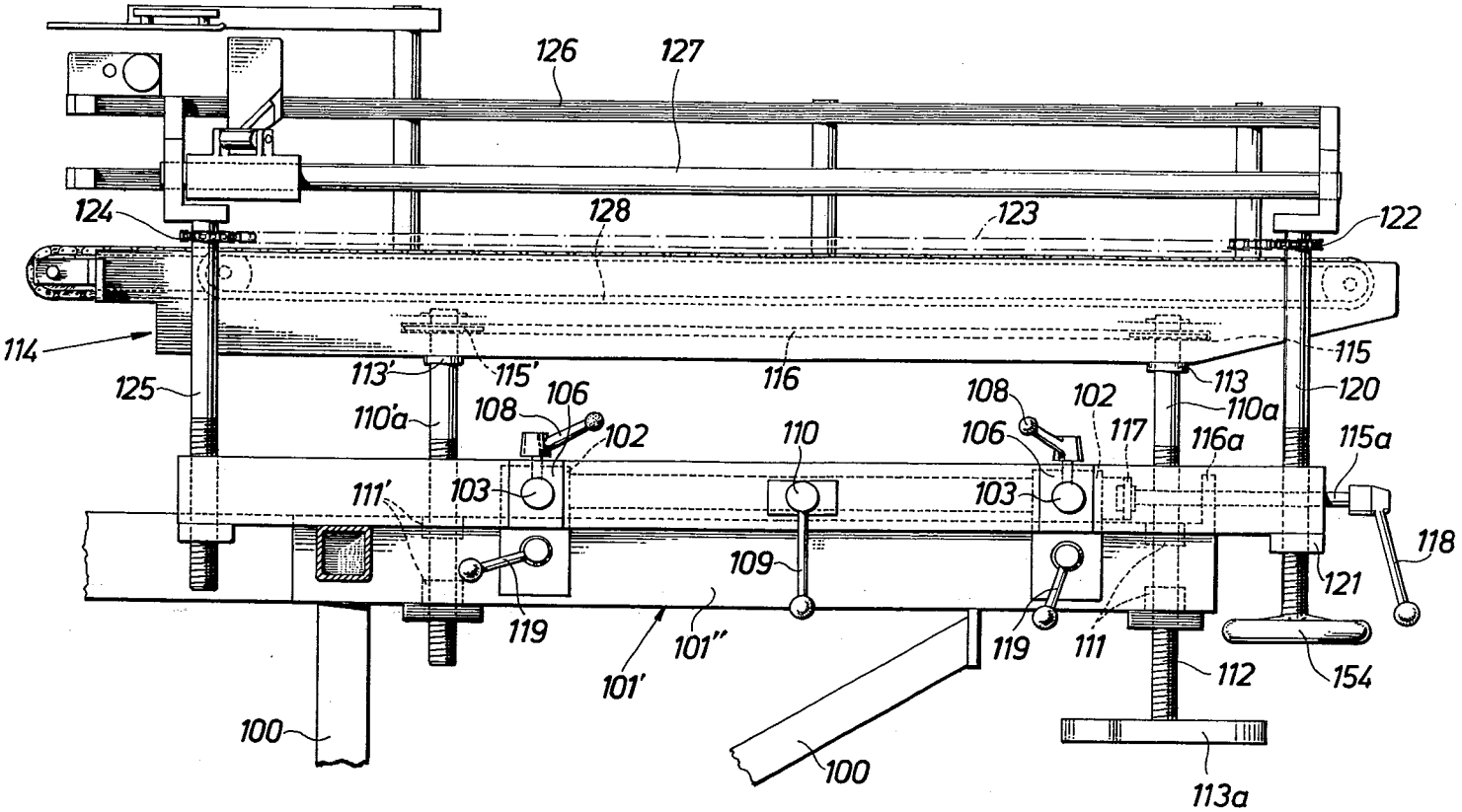
FIG. 3 is a side elevation view of the storage area seen from the frontal long-side of the machine in FIG. 1.

As appears from FIGS. 2 and 3 the storage structure is carried by a beam construction 101 carried on the frame of the machine by means of bars 100. The beam construction 101 consists of two beams 101', 101'' connected with each other and extending in the longitudinal direction of the storage structure. Each of said beams carries a pair of yokes 102, and in each of the yokes one end of a horizontal shaft 103 is locked by means of a screw in a bore 104. The opposite end of each shaft 103 extends through a beam 105. On the outside of each beam 105 is mounted a locking block 106 with a locking screw 107 extending through the block. The locking screw 107 is brought into and out of engagement with the shaft 103 through the operation of locking arm 108 which may be rotated in either direction.

Approximately in the middle of the beam 105 is mounted a further operating arm 109 which is connected to a shaft 110 extending through the beam 105 and which, in a suitable manner (not shown) is anchored in the yoke beam 102. Although it is not shown in FIG. 3, a similar arrangement of an arm 109 and a shaft 110 and also a corresponding number of locking blocks 106 and locking arms 108 are mounted at the opposite side of the storage structure.

At the end of the storage area facing away from the machine is mounted a vertical shaft of screw **110*a* connected to the beams 101', 101'', which in the region of two blocks 111 secured in the frame means 101 is provided with threads 112. By means of a hand wheel 113*a* secured to the bottom end of the screw 110*a* the shaft or screw 110*a* is vertically displaceable in relation to the beams 101', 101''. The shaft or screw 110*a* is journalled in an upper block 113 which is rigidly secured in the underside of the feeding storage bottom 114. On the top end of the screw 110*a* is mounted a sprocket 115, and about this sprocket runs an endless chain 116 to a corresponding sprocket 115' on a second screw or shaft 110'*a*. Corresponding to the arrangement of the screw 110*a* block 113' is secured to the storage bottom 114**.

By means of the arrangement of screw **110*a*, 110'*a*, the storage bottom 114 may be vertically moved by rotating the hand wheel 113*a*. This rotation of hand wheel 113*a* causes the two screws 110*a*, 110'*a* to each vertically displace respective ends of the storage bottom 114** the same distance.

By means of the previously described arrangement of blocks 106, locking arms 108 and operating arms 109 it also is possible by rotating either operating arm 109 to laterally displace the respective beam 105 in relation to the storage structure.

However, in order that the beams 105 may be displaced in the longitudinal direction of the storage structure independent of each other, there is a further pair of screw-operating mechanisms, of which only the mechanism for the right beam 105 in FIG. 2 is shown in FIG. 3. As appears from this figure, a threaded screw **115*a* extends through a threaded disk 116*a* which is fixedly mounted on the beam 101''. The screw 115*a* at its front end is secured in a transverse plate 117 fixedly mounted on the yoke 102. At its opposite end the screw 115*a* is provided with an operating arm 118, in response to the rotation of which the yoke 102 and the shaft 103 connected therewith, and the elements rigidly connected to the respective beam 105 may be adjusted in the longitudinal direction of the storage structure, provided that previously locking arms 119 for the respective yoke 102 are released. When said locking arms are tightened, they will squeeze the yokes 102 against the respective beam 101', 101''**.

The right beam 105 in FIG. 2 at the end of the storage structure facing away from the machine is provided with a further screw 120, which at the underside of the beam 105 is threaded into a block 121. At its top end the screw 120 is provided with a sprocket 122 about which an endless chain 123 is running and extends to and about a further sprocket 124 secured to the top end of a screw 125 journalled in the beam 105.

Figure 5:
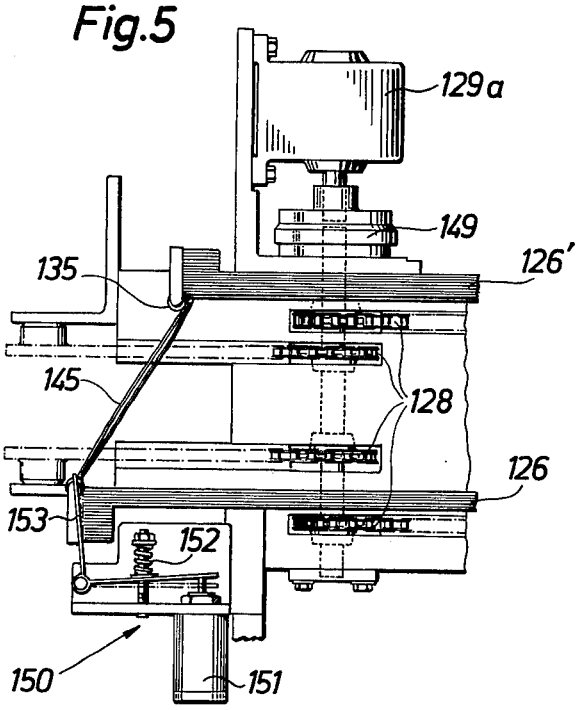
FIG. 5 shows schematically the control means of the motor used to feed the folding box blanks in the storage area.

With this arrangement a pair of rails 126 serving as side guiding means may be vertically adjusted in that a hand wheel 154 is rotated in either direction. To said guiding rails is also rigidly connected a pair of further rails 127 (FIG. 2) serving as guide means for a carriage 129 driven by chains 128. The chains 128 in turn are driven by a gear wheel motor 129*a* (FIG. 5). The carriage 129 carries a pressure plate 130 which bears against the carton blanks 132 on the bottom plate 131 of the storage bottom 114 in order to move blanks towards the discharge end of the storage area, i.e. the left end in FIG. 3.

The left side of the storage structure as seen in FIG. 2 also is provided with guide rails 126', however, since these rails are not associated with a carriage of the abovementioned kind (129) the readjustment of the vertical position of said guide rails 126' is made by easing off of locking arms 133 on carriers 134', after which the rails 126' are adjusted into the desired position.

At the front ends of the rails 126, 126' are mounted rollers 135 (FIG. 2) serving as stop means. By means of these rollers the folding box blanks 132 are adjusted into a desired angled position in relation to the longitudinal direction of the storage bottom 114. As mentioned above, this adjustment may be simply made in that the beams 105 are individually displaced completely independent of the position of the storage bottom plate 131 and the lateral adjustment of the beams 105, because carriers 134' at the left side in FIG. 2 by means of upright members 136 are rigidly connected to the left beam 105, and as previously mentioned the carriage side of the storage structure is rigidly connected to the right beam 105 by means of the screws 120, 125.

Accordingly, the described arrangement makes possible a mutually independent readjustment of both the bottom of the storage structure and the side guiding means for the folding box blanks in the storage area, and moreover the blanks simply may be adjusted into a desired angled position in relation to the longitudinal direction of the storage structure. This is important in order to obtain the intended function of feeding the blanks from the storage area.

Figure 4:
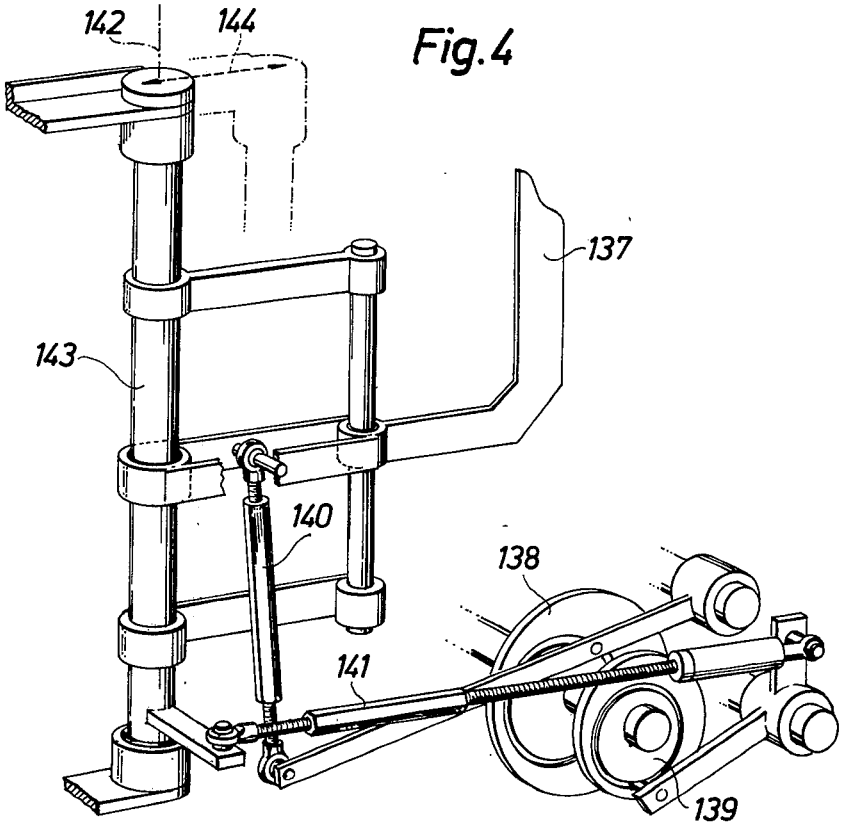
FIG. 4 shows schematically a spade means used to feed and erect folding boxes.

To this end a spade means of the type shown in FIG. 4 is utilized. The motion of the spade 137 comprises an up-and-down motion and a rotating motion. Principally, this motion is received from two cam disks 138, 139 driven from the main motor 29 (FIG. 1). Cam disk 138, by means of a link mechanism 140, imparts the up-and-down motion to the spade 137, whereas cam disk 139, by means of a further link mechanism 141, imparts said rotating motion to the spade 137. In this connection it is important that the center 142 of motion of the spade 137 may be adjusted dependent upon the folding box size. To this end the motion shaft 143 of the spade 137 in the described storage area 31 is adjustably secured in a carrier (not shown) on the machine frame. The dashed line 144 indicates the possible adjustment of the motion center. However, since the driving means of the spade 137 is well known, the driving will not be further described in this connection.

As mentioned above, the folding box blanks in the storage area 31 are fed upwards the discharge end thereof by means of chains 128 driven from the motor 129*a*. To insure that the spade 137 will be introduced into the open bottom end of the folding box 145 (FIG. 5) which is in discharge position, the driving must not be of such a type that the plane folding box blanks are compressed beyond a maximally allowed compression in the storage area.

In order to insure that the maximally allowable compression is not exceeded, the drive motor 129*a* is provided with a magnetic coupling 149 controlled by an inductive sensing means 150, which principally consists of a solenoid 151 having a keeper 153 loaded by a spring 152.

When the folding box blank 145 shown in FIG. 5 engages the keeper 153 so that it occupies the position shown in full lines, the magnetic coupling 149 releases the drive of the chains 128 after which a further feeding of folding box blanks is interrupted. When the foremost blank of folding boxes has been removed from the storage by means of the spade 137, the keeper 153 returns into the position shown in dashed lines, at which time the feeding of carton blanks is again started until the sensing means 150 again registers a maximally allowed loading.

To insure that feeding of folded box blanks will additionally be stopped at the introduction of the spade 137 into a blank in discharge position, the motor 129*a* in this operation phase is stopped also by a cam on either of the camshafts 61 driven from the main motor 29 (FIG. 1; only one of the shafts 61 is shown), each of said shafts being driven by means of the arrangement of worm gears 62, 64, chain 65 and shaft 63.

The feeding of folding box blanks also may be forcibly interrupted at any time in that the keeper 153 by means of a lever (not shown) is forcibly moved into the position indicated in full lines in FIG. 5.

Accordingly, there has been described an improved size adjustable carton storage, feeding and opening apparatus. It is understood that the above-described embodiment is merely illustrative of the principles of this invention. Numerous other arrangements may be devised by those skilled in the art without departing from the spirit and scope of this invention, as defined by the appended claims.

I claim:

1. Carton storage, feeding and opening apparatus for use in a packaging machine in which plane folding box blanks are fed to a conveyor with simultaneous opening of the folding box blanks which are subsequently fed one after another in a predetermined direction with substantially constant center-to-center distances to processing stations along the conveyor, said apparatus comprising:

a substantially horizontal storage bottom member, said bottom member being vertically adjustable;

a pair of side guiding means for folding box blanks substantially vertically carried by the storage bottom member, said side guiding means being adjustable independently of each other and of the storage bottom in longitudinal and latitudinal direction in relation to said storage bottom member; and stop means mounted on said side guiding means at the discharge end of said apparatus adjacent said conveyor, said stop means adapted to fix the position of folding box blanks in a predetermined angular orientation with respect to the longitudinal direction of the storage bottom member.

2. The apparatus according to claim 1 further including:

a carriage member;

a pressure plate secured to said carriage member; and means for driving said carriage member toward the discharge end of said apparatus, thereby feeding the folding box blanks towards said stop means.

3. The apparatus according to claim 2 further comprising:

pressure sensing means for sensing the pressure of box blanks forced against said stop means; and means responsive to said pressure sensing means for deactivating said drive means said pressure exceeds a predetermined threshold.

4. The apparatus according to claim 3 further comprising:

a spade member introducible into the open bottom end of a folding box blank at the discharge end of said apparatus for feeding said folding box blank to the conveyor; and means for driving said spade member so as to perform both a vertical reciprocating motion and a rotational motion, the center of rotational motion of the spade member being adjustable dependent upon the folding box size.

* * * * *